US009032764B2

(12) United States Patent
Yeh

(10) Patent No.: US 9,032,764 B2
(45) Date of Patent: May 19, 2015

(54) SAFETY LOCKOUT HASP WITH CABLE

(71) Applicant: ASSA ABLOY Australia Pty Limited, Victoria (AU)

(72) Inventor: Kevin Chia-Hao Yeh, Victoria (AU)

(73) Assignee: ASSA ABLOY Australia Pty Limited, Victoria (AU)

( * ) Notice: Subject to any disclaimer, the term of this patent is extended or adjusted under 35 U.S.C. 154(b) by 0 days.

(21) Appl. No.: 13/921,812

(22) Filed: Jun. 19, 2013

(65) Prior Publication Data

US 2014/0000324 A1 Jan. 2, 2014

(30) Foreign Application Priority Data

Jun. 25, 2012 (AU) ..... 2012902676

(51) Int. Cl.

| | |
|---|---|
| ***E05B 73/00*** | (2006.01) |
| ***E05B 65/00*** | (2006.01) |
| ***E05B 67/00*** | (2006.01) |
| *G05G 5/00* | (2006.01) |
| *E05B 63/14* | (2006.01) |
| *E05B 67/38* | (2006.01) |

(52) U.S. Cl.

CPC ..... *E05B 65/00* (2013.01); *G05G 5/005* (2013.01); *E05B 63/143* (2013.01); *E05B 67/003* (2013.01); *E05B 67/383* (2013.01)

(58) Field of Classification Search

CPC ..... E05B 67/383; E05B 67/003; G05G 5/005; F16P 3/08

USPC ..... 70/14, 18, 19, 51, 53, 58, DIG. 63

See application file for complete search history.

(56) References Cited

U.S. PATENT DOCUMENTS

| | | | |
|---|---|---|---|
| 1,197,020 | A | 9/1916 | Farrar |
| 2,560,624 | A | 7/1951 | Bartlett |
| 2,963,895 | A | 12/1960 | Thomas |
| 3,667,259 | A | 6/1972 | Reque et al. |

(Continued)

FOREIGN PATENT DOCUMENTS

| | | |
|---|---|---|
| EP | 0831199 | 3/1998 |
| WO | WO 02/077901 | 10/2002 |

OTHER PUBLICATIONS

International-Type Search Report prepared by the Australian Patent Office for National Application No. 2010902181, mailed Aug. 6, 2010, 3 pages.

(Continued)

*Primary Examiner* — Suzanne Barrett

(74) *Attorney, Agent, or Firm* — Sheridan Ross P.C.

(57) ABSTRACT

A safety lockout hasp for interaction with equipment, infrastructure, machinery, appliances, tools, implements and the like. The hasp comprising a body, a cable for engaging the plant and a movable member being movable relative to the body between an open condition and a closed condition. The movable member interacting with the cable such that in the closed condition an intermediate portion of the cable is secured in its position relative to the body. The movable member also interacts with the body such that in use in the closed condition the hasp can accommodate a plurality of locking elements so that the hasp is prevented from disengagement from the plant when accommodating at least one of the plurality of locking elements, and when the movable member is in the open condition the hasp is prevented from accommodating any of the locking elements.

20 Claims, 5 Drawing Sheets

(56) References Cited

U.S. PATENT DOCUMENTS

| | | | | |
|---|---|---|---|---|
| 4,085,599 | A | 4/1978 | Fischer | |
| 4,409,804 | A | 10/1983 | Sork | |
| 4,864,834 | A | 9/1989 | Waite | |
| 5,020,342 | A | 6/1991 | Doan et al. | |
| 5,070,712 | A * | 12/1991 | Fox | 70/18 |
| 5,167,135 | A | 12/1992 | Gobeski | |
| 5,365,757 | A | 11/1994 | Primeau | |
| 5,582,042 | A | 12/1996 | Mordick | |
| 5,743,116 | A | 4/1998 | Suster | |
| 5,881,582 | A | 3/1999 | Monaco | |
| 5,907,962 | A | 6/1999 | Smithson et al. | |
| 5,956,980 | A | 9/1999 | Jenkins, Jr. | |
| 6,530,248 | B1 | 3/2003 | Parker | |
| 6,622,532 | B2 * | 9/2003 | Hsu | 70/14 |
| 7,124,606 | B2 | 10/2006 | Turek | |
| D615,393 | S * | 5/2010 | Cunningham et al. | D8/394 |
| 8,297,086 | B2 * | 10/2012 | Yu et al. | 70/14 |
| 8,347,671 | B2 * | 1/2013 | Brojanac et al. | 70/178 |
| 8,353,182 | B2 | 1/2013 | Triffle | |
| 8,408,609 | B2 * | 4/2013 | Brojanac | 292/285 |

OTHER PUBLICATIONS

Official Action for U.S. Appl. No. 13/110,170 mailed Dec. 15, 2011, 8 pages.

Official Action for U.S. Appl. No. 13/110,170 mailed Mar. 23, 2012, 8 pages.

Notice of Allowance for U.S. Appl. No. 13/110,170 mailed Jun. 19, 2012, 10 pages.

* cited by examiner

SAFETY LOCKOUT HASP WITH CABLE

CROSS REFERENCE TO RELATED APPLICATIONS

This application claims the benefit of Australia Application No. 2012902676 filed 25 Jun. 2012, the entire disclosure of which is incorporated by reference herein.

FIELD OF THE INVENTION

This invention relates to a safety lockout hasp for interaction with plant. Throughout this specification the use of the term plant is intended to be a general term for equipment, infrastructure, machinery, appliances, tools and implements. The invention has been developed for use in the preventing the release of electrical energy to machinery and it will be convenient to hereinafter describe the invention with reference to this particular application. It is to be appreciated however that the hasp may be used with plant to prevent the release of other forms of energy such as fuels, fluids under pressure or the like. Furthermore the hasp may be used to in a more direct sense of preventing operation or access of and to the plant.

BACKGROUND OF THE INVENTION

The supply of electrical energy to a machine often needs to be interrupted to allow for maintenance on the components of the machine. The person conducting the maintenance may need to access parts of the machine that could be harmful if energy is being supplied to the machine. The machine may have exposed electrical terminals, or the electrical energy may cause movement to the components that could cause physical harm to the person. The machine may be of such a size that the person is maintaining a part of the machine that is remote from the electrical switch, and the switch may be inadvertently turned on causing harm to the person maintaining the machine. Alternatively multiple people may be conducting separate maintenance tasks on the machine, and it may not be clear that all those tasks are complete. One person may have left to collect replacement parts only to have the switch turned on in their absence. This may cause damage to the person when they return, or even damage the machine. It is therefore desirable to lockout the machine from the electricity source.

The switch controlling the supply of electrical energy to the machine is often located within a box, whereby the lid to the box can be locked in a closed position with a padlock. The box may include a metal hoop, often referred to as a staple, which fits through an opening in the lid and receives the shackle of the padlock. Alternatively the switch may include an aperture, which is exposed when the switch is in an "off" position, that accommodates the shackle to prevent it being moved to the "on" position. It is generally desirable for each person maintaining the machine to have their own padlock, however the size of the aperture or staple will generally only accommodate a single shackle. Where more than one person is maintaining the machine, it is preferred to provide a safety lockout hasp as it can accommodate more than one padlock.

A safety lockout hasp generally includes a shackle that can be attached to the aperture or staple. The shackle of the hasp can be moved to an open condition for attaching the hasp to the staple, and then moved to a closed position. The shackle of the hasp is retained in its closed position when a padlock is secured to the hasp. The hasp includes a plurality of apertures, each aperture for accommodating the shackle of a padlock.

The plurality of apertures allows each person maintaining the machine to attach their padlock to the hasp, so that the shackle of the hasp can not be moved to the open condition without each of the padlocks being removed.

One problem with the shackle of the hasp is that it requires the plant to include features, such as a staple, that is specifically designed to accommodate it. It will be appreciated that not all plant will include the necessary features to accommodate the shackle. It may be the case that the plant was not designed with these features, or that the features have been subsequently obscured, damaged or destroyed. The plant may include other features not specifically designed for use with a shackle of the hasp, but still could be utilised to prevent operation of the plant. Unfortunately the shackle is not particularly adaptable for accommodating those other features.

Another problem with existing hasps is that the padlock can be attached to the hasp without the shackle of the hasp being in the closed condition. This can result in the hasp being attached to the machine, a padlock being attached to the hasp, and yet the hasp is still not in a closed condition. This will allow for the hasp to be detached from the machine while a padlock is attached, and more critically allow for electricity to be supplied to the machine.

A reference herein to a patent document or other matter which is given as prior art is not to be taken as an admission that that document or matter was, in Australia, known or that the information it contains was part of the common general knowledge as at the priority date of any of the claims.

According to this invention there is provided a safety lockout hasp for interaction with plant, the hasp including, a body, a cable for engaging the plant, a movable member being movable relative to the body between an open condition and a closed condition, the movable member interacts with the cable such that in the closed condition an intermediate portion of the cable is secured in its position relative to the body, the movable member also interacts with the body such that in use in the closed condition the hasp can accommodate a plurality of locking means so that in use the hasp is prevented from disengagement from the plant when accommodating at least one of the plurality of locking means, and when the movable member is in the open condition the hasp is prevented from accommodating any of the locking means.

The movable member may take any form however it is preferred that it includes a clamp portion that when the movable member is in the closed condition engages the intermediate portion of the cable. The degree to which the clamp portion engages the cable may vary however it is preferred that the engagement hinder the ability of the cable to be pulled from the body of the hasp. The body preferably includes an abutment portion which combines with the clamp portion of the movable member to engage the cable when the movable member is in the closed position, however the clamp portion may be formed with its own abutment portion. It is preferred that the clamp portion and/or the abutment portion includes at least one tooth which resiliently deforms the intermediate portion of the cable when the movable member is in the closed condition. This preferably enhances the ability of the hasp to hinder the ability of the cable to be pulled from the body of the hasp.

The movable member can move relative to the body in any suitable way, however it is preferred that the movable member pivots relative to the body when adjusting between the open and closed conditions. Alternatively the movable member may translate rather than pivot, for example. It is preferred that the hasp include biasing means for biasing the movable member towards the closed condition. The biasing means may take any suitable form including but not limited to a torsion spring.

The movable member preferably includes an engaging portion for additionally or alternatively engaging the plant, whereby when the movable member is in the open condition the engaging portion can engage and disengage from the plant, and when in a closed condition the engaging portion is prevented from engaging and disengaging from the plant when the hasp is accommodating said at least one locking means. The engaging portion may take any form however its preferred form is a shackle.

It is preferred that the movable member includes a lock receiving portion which accommodates the plurality of locking means. This may take any form however in the preferred form the lock receiving portion includes a plurality of apertures each extending through the lock receiving portion with each aperture configured to accommodate one of said plurality of locking means. It is preferred that the apertures in the lock receiving portion are obscured when the movable member is in the open condition so as to prevent accommodating any of the locking means. Obscuring the apertures prevents the operator from attaching a lock to the hasp to thereby reduce the likelihood of the plant being operational while the operators lock is attached. It is preferred that the locking means is a padlock and each aperture in the lock receiving portion is configured to accommodate a shackle portion of the padlock, however this may vary. When a padlock is used by the operator it is preferred that the shackle of the padlock abuts the body when preventing movement of the movable member from the closed position.

It is preferred that the movable member be fixed to the body and the body includes a pair of stops that limit movement of the movable member between the open and closed conditions. This reduces the likelihood that the movable member will be separated from the body rendering the hasp inoperable. It is further preferred that the body includes a cable aperture to receive the cable adjacent a proximal end thereof, the cable having an enlarged proximal end to prevent the cable from being pulled through the cable aperture so as to relatively fix the cable to the body. It is preferred that the cable includes a block at a proximal end which abuts the body surrounding the cable aperture to prevent the cabled being pulled through. Again this reduces the likelihood that the cable will be separated from the body rendering the hasp inoperable.

It is preferred that the body includes a further aperture which in use can accommodate a further lock means or further hasp so as to prevent movement of the movable member from the closed position. The location of the further aperture may be in any suitable location however it is preferred that the body is formed with a front wall and a rear wall, wherein the further aperture extends through the front wall and the rear wall. It is further preferred that the movable member and body are arranged such that the movement of movable member from the closed condition obscures the further aperture.

It will be convenient to hereinafter describe the invention in greater detail by reference to the accompanying drawing showing a preferred embodiment of the invention. The particularity of the drawings and the related detailed description is not to be understood as superseding the generality of the proceeding broad description of the invention.

DETAILED DESCRIPTION OF THE DRAWINGS

Figure 1:
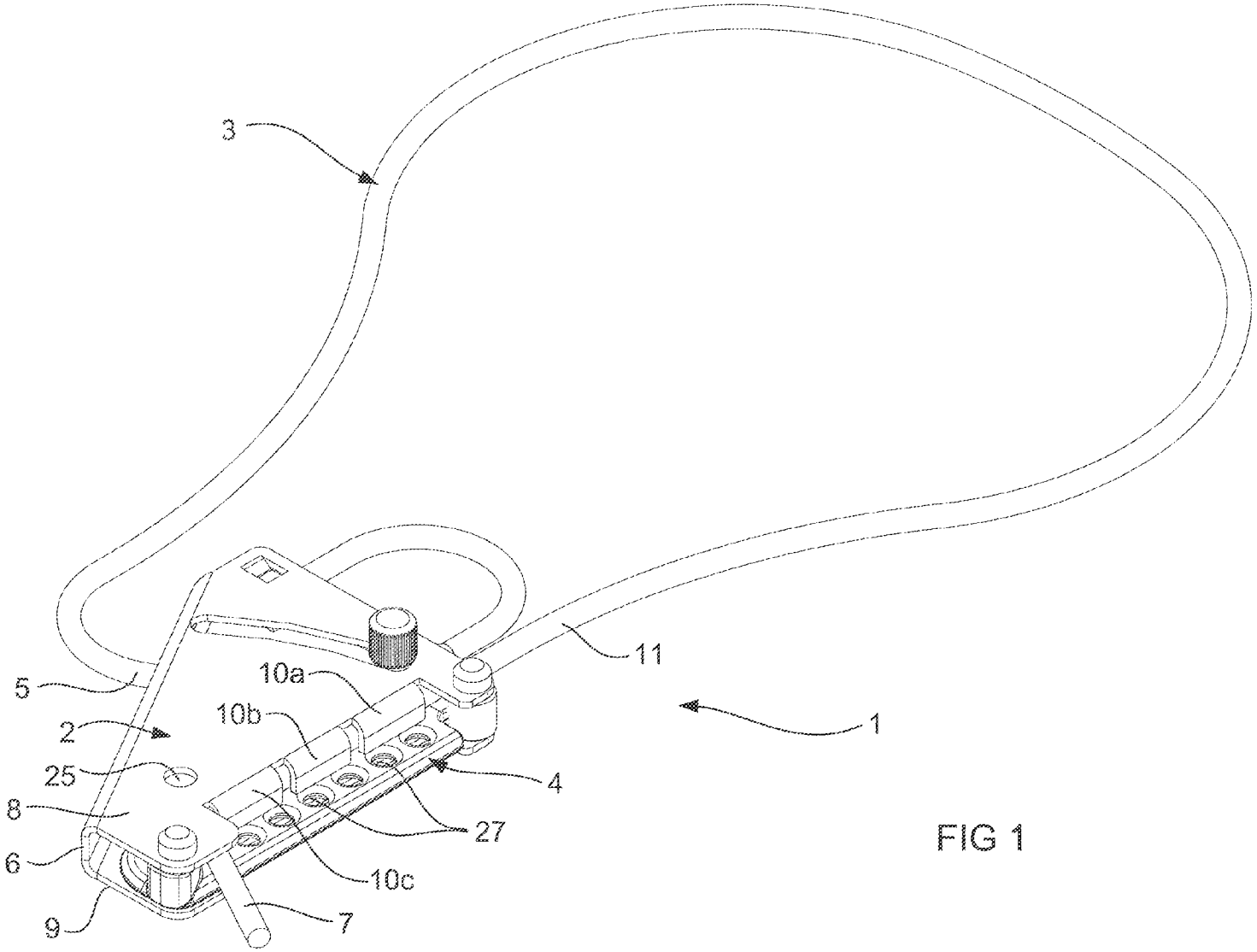
FIG. 1 is an isometric view of a preferred embodiment of a safety lock out hasp according to the invention.

FIG. 1 illustrates a preferred embodiment of a safety lock-out hasp 1 for interaction with plant 28 (see FIGS. 4, 5) which in summary includes a body 2, a cable 3 and a moveable member 4 (partly obscured). FIG. 1 illustrates the moveable member 4 in a closed condition, however the moveable member 4 can move relative to the body 2 so as to adopt an open condition, and that movement will be described in greater detail by reference to the later illustrations.

The cable 3 illustrated in FIG. 1 includes a proximal end 5 which is illustrated extending from a side wall 6 of the body 2 and making a loop back on itself to enter a top of the body 2. The cable 3 extends through the body 2 and a distal end 7 exists the body 2 adjacent a bottom of the body 2. It would be appreciated that the size of the loop can be adjusted by pulling the distal end 7 of the cable through the body 2 to the desired length, and the loop of the cable is not limited to that as illustrated in FIG. 1. The cable 3 provides one option for attaching the hasp to plant 28 (see FIG. 5), particularly when the features of the plant for accommodating the hasp are spread apart (such as the handles 29 shown on the plant 28 in FIG. 5).

The hasp illustrated in FIG. 1 is formed from a folded sheet, preferably of metal, to form a front wall 8, the side wall band a rear wall 9. FIG. 1 also illustrates a series of abutments 10*a*, 10*b*, 10*c* which extend from the front wall 8, located on an edge of the front wall 8 remote from the side wall 6. The abutments 10 interact with an intermediate portion 11 of the cable 3 to clamp it in position. The abutments 10 also interact with locking means 12 (see FIG. 5) in a manner which will be described in detail by reference to later illustrations.

Figure 2:
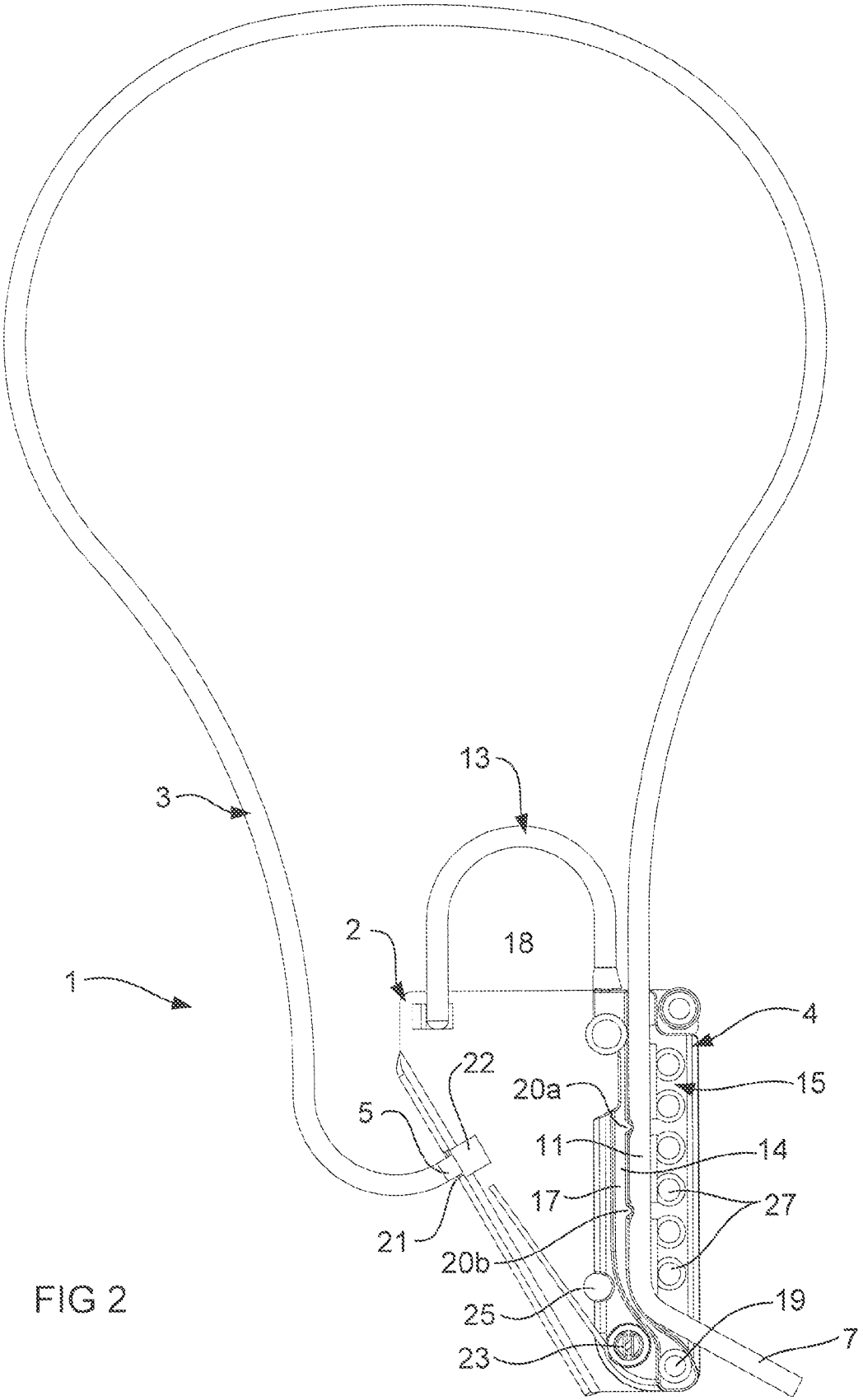
FIG. 2 illustrates a front elevation view of the hasp with the front wall removed to reveal the moveable member in greater detail.

FIG. 2 illustrates that the moveable member 4 including a shackle portion 13, a clamp portion 14 and a lock receiving portion 15. The shackle portion 13 is for use in attaching the hasp 1 to a staple 16, or like feature, associated with the plant (see FIG. 4). Whilst the shackle portion 13 is illustrated as having a substantially U-shape, it ought to be appreciated that the shape of the shackle portion 13 may vary. The shackle 13 provides another option for attaching the hasp 1 to plant (see FIG. 4).

The clamping portion 14 of the moveable member is designed to engage the intermediate portion 11 of the cable 3 so as to prevent the movement of the intermediate portion 11 of the cable 3 relative to the body 2 of the hasp 1. The clamping portion 14 may take any suitable form and in the embodiment illustrated in FIG. 2, the clamping portion 14 includes a wall 17 extending from a fixed end 18 of the shackle portion 13 to a pivot 19 of the moveable member 4 positioned adjacent the bottom of the body 2. The wall 17 extends substantially parallel to the abutments 10, and combines with abutments 10 to clamp the intermediate portion 11 there between when the moveable member 4 is in the closed position as illustrated in FIG. 2. It is preferred that the clamping portion 14 includes an enhancement to facilitate the clamping action, and this enhancement may take any form. The form illustrated in FIG. 2 includes a pair of teeth 20*a*, 20*b* formed on the wall 17 which are illustrated deforming the cable 3. It ought to be appreciated that the location and number of teeth 20 as illustrated may vary, and for example the teeth 20 may be located on the inner surface of the abutments 10.

FIG. 2 also illustrates the proximal end 5 of the cable 3 positioned adjacent an aperture 21 formed in a side wall 6 of the body 2. It is preferred that the proximal end 5 of the cable 3 is relatively fixed in its position so as to prevent the proximal end 5 of the cable 3 from being pulled out of the side wall 6 when attached to the plant. This may be achieved by any suitable arrangement. In the arrangement illustrated in FIG. 2, the proximal end 5 of the cable includes a block 32 attached thereto which is sized and shaped to be larger than the aperture 21 so as to prevent the proximal end 5 of the cable 3 from being pulled through the aperture 21. Other arrangements for achieving the same function at the proximal end 5 are clearly possible. This has the advantage that the cable 3 is relatively attached to the body 2 so as to reduce the likelihood of the cable 3 being misplaced. It also has the advantage that the operator only has to arrange the distal end 7 of the cable 3 relative to the body 2, which simplifies the attachment process.

It is preferred that the moveable member 4 be biased towards its closed condition as illustrated in FIG. 2. The means for biasing the moveable member may take any suitable form and in the embodiment illustrated in FIG. 2, a spring biasing means 23 is included. Other arrangements are clearly possible, particularly if the movable member 4 was to move relative to the body in a motion other than pivoting.

Figure 3:
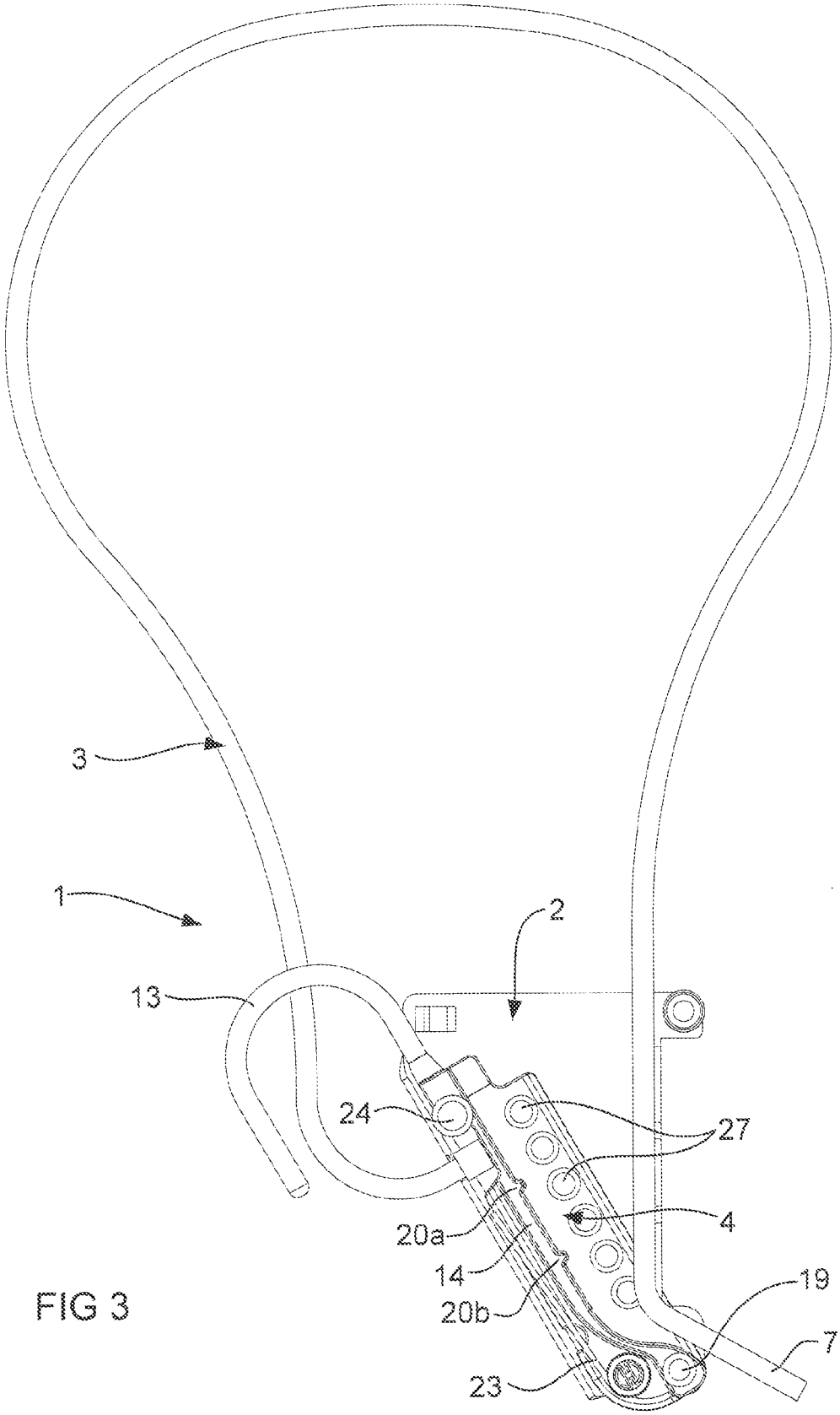
FIG. 3 illustrates the hasp from FIG. 2 with the moveable member in an open condition.

While FIG. 2 illustrates the moveable member 4 in the closed position, FIG. 3 illustrates the moveable member having been pivoted to the open condition. It ought to be appreciated from FIG. 3 that when the moveable member 4 is in the open condition, the distal end 7 of the cable 3 can be threaded through the body 2 between the clamping portion 14 and the abutment 10 (see FIG. 1), and pulled out through the bottom of the body 2 to adjust the size of the loop in the cable. It should also be appreciated from FIG. 3 that when the moveable member 4 is in the open condition, the shackle portion 13 can be attached to and detached from a staple 16 such as that illustrated in FIG. 4. Whilst a knob 24 associated with the moveable member 4 has been provided for facilitating moving of the moveable member 4 relative to the body 2, it ought to be appreciated that this knob 24 is merely preferred. More specifically, the moveable member 4 could be moved from the closed position by the operator moving the shackle portion 13 relative to the body 2.

Figure 4:
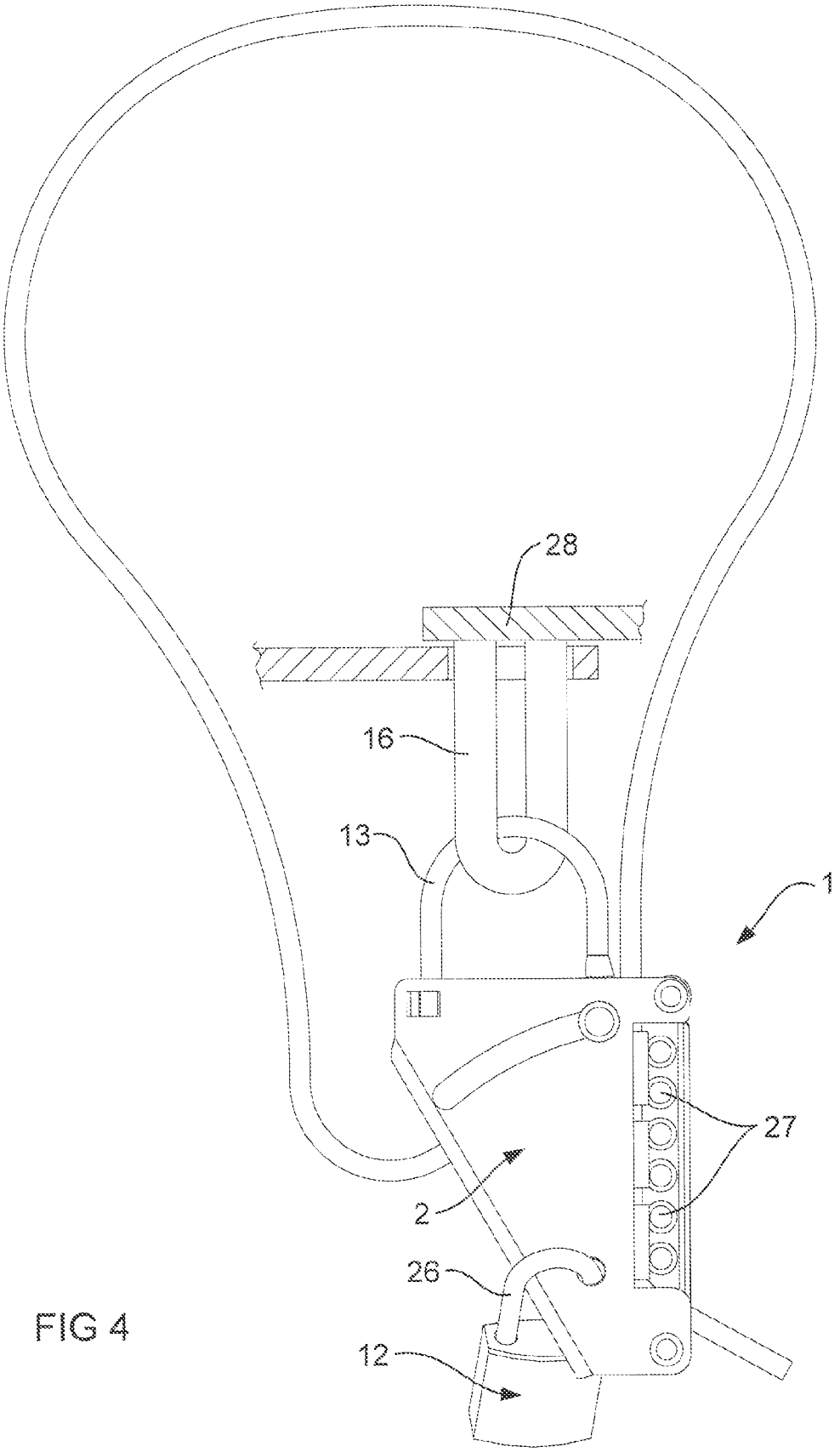
FIG. 4 illustrates a preferred embodiment of the hasp attached by its shackle to plant, with a locking means engaging the body of the hasp.

FIG. 4 illustrates the hasp 1 attached via the shackle portion 13 to the staple 16 of the plant 28. A preferred form of locking means 12 in the form of a padlock is illustrated attached to the body 2 of the hasp 1. More specifically the body 2 of the hasp 1 includes an aperture 25 (see FIG. 1) formed in the front wall 8 and rear wall 9 of the body 2 which can accommodate the shackle 26 of a padlock 12. It can be appreciated from FIG. 2 that the position of this aperture 25 relative to the movable member 4 is such as to prevent movement of the moveable member 4 from the closed position when the shackle 26 of the padlock 12 is located in the aperture 25. Whilst in the embodiment illustrated in FIG. 4 the aperture 25 is accommodating the shackle 26 of the padlock 12, it ought to be appreciated that the aperture 25 in the body 2 may also accommodate the shackle portion 13 of a further hasp 1. Whilst the figures illustrate the body 2 only having one aperture 25 to accommodate a shackle 26, 13, it should be appreciated that more apertures 25 in the body 2 could be provided.

The cable 3 may be in any form however it is preferred that the cable 3 be relatively robust. The cable 3 must not only support the weight of the body 2 of the hasp 1, but also support any padlocks 12, or further hasps 1 that are attached to the body 2. It is also preferable that the cable 3 be sufficiently robust to withstand the conditions that it may be operating in. The hasp 1 may be used in industrial, construction or mining environments and the normal operating conditions may result in the cable 3 being placed under a reasonable level of tension. Furthermore it is desirable that the cable 3 provide some level of resistance to an operator trying to circumvent the function of the hasp 1, by trying to force the cable 3 to break. In this regard it is preferred that the cable 3 be formed from a plastic sheathed metal wire, however clearly other forms of cable are possible. Furthermore the plastic sheathing permits plastic deformation of the cable 3 when engaged by the teeth 20 of the clamping portion 14.

Referring again now to FIG. 5 which illustrates the lock receiving portion 15 of the moveable member 4 accommodating the shackle 26 of two padlocks 12. It ought to be appreciated that locating at least one padlock 12 in the lock receiving portion 15 prevents movement of the moveable member 4 from the closed position. Furthermore, providing multiple apertures 27 in the lock receiving portion 15 allows the hasp 1 to accommodate multiple padlocks 12, which in use allows for multiple operators to independently prevent operation of a plant. While the embodiment illustrated in at least FIG. 5 includes six apertures 27 in the lock receiving portion 15, this number may vary.

The provision to accommodate a padlock 12 through the body 2, and multiple padlocks 12 on the movable member 4, could be used to establish a primary and secondary means of controlling operation of the plant. The primary controller being the maintenance supervisor could use the aperture 25 in the body 2, whilst the secondary controllers being those that are working on the plant could use the apertures 27 in the lock receiving portion 15. This would enhance the ability to work safely on the plant.

Figure 5:
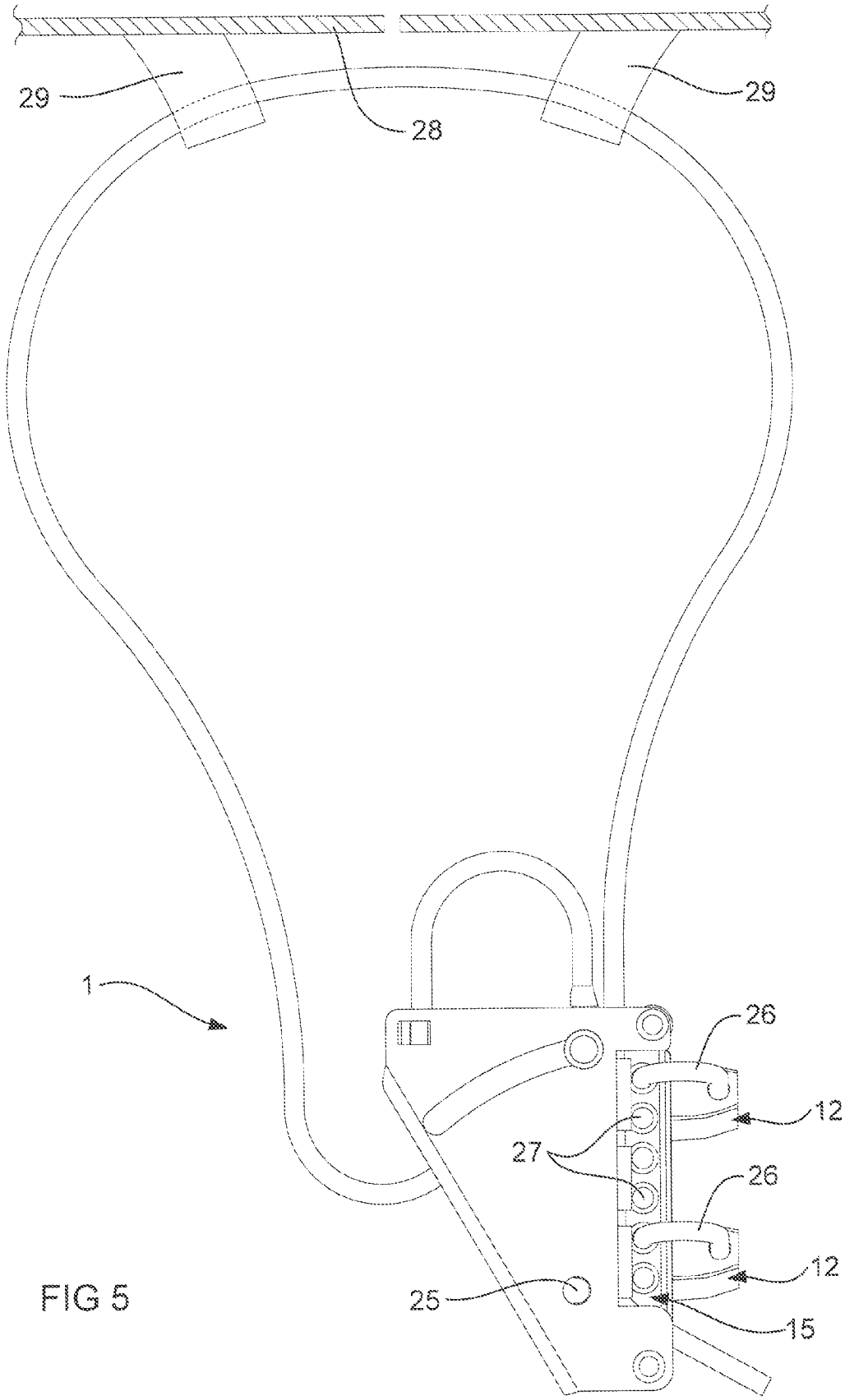
FIG. 5 illustrates the hasp attached to plant via its cable with locking means engaging the lock receiving portion of the moveable member.

Whilst FIG. 5 illustrates the lock receiving portion 15 being capable of accommodating six padlocks 12 in the closed position, it can also be appreciated when comparing FIG. 5 with FIG. 3 that the lock receiving portion 15 is prevented from accommodating any padlock 12 when the moveable member 4 is in the open condition. This is achieved by the body 2 obstructing the apertures 27 in the lock receiving portion 15. Still furthermore it should be appreciated from FIG. 3 that the further aperture 25 formed in the body 2 of the hasp 1 is prevented from accommodating a padlock 12 when the moveable member 4 is in the open condition. This has the practical advantage of preventing operators from attaching their padlock 12 whilst the hasp 1 is in the open condition. It will be appreciated that when the hasp 1 is in the open condition it can be attached and detached from the plant. It is therefore desirable from a safety perspective that operators be only allowed to attach their padlock 12 to the hasp 1 when the moveable member 4 is in a closed position. The inclusion of a biasing means 23 to urge the moveable member 4 to adopt the closed position enhances this safety aspect. Furthermore, the ability of the operator to select between the shackle portion 13 and the cable 3 for use in attaching the hasp 1 to the plant, provides a unique advantage.

Various alterations and/or additions may be introduced to the safety lockout hasp as hereinbefore described without departing from the spirit or ambit of the invention.

The claims defining the invention are as follows:

1. A safety lockout hasp for interaction with plant, the hasp including, a body, a cable for engaging the plant, a movable member being fixed to the body and pivotally movable relative to the body between an open condition and a closed condition, the movable member interacts with the cable such that in the closed condition an intermediate portion of the cable is secured relative to the body and when the movable member is in the open condition the intermediate portion of the case is free to move relative to the body for disengaging from the plant, the movable member also interacts with the body such that in use in the closed condition the hasp can accommodate a plurality of locking means so that in use the hasp is prevented from disengagement from the plant when accommodating at least one of the plurality of locking means, and when the movable member is in the open condition the hasp is prevented from accommodating any of the locking means.

2. A safety lockout hasp according to claim 1 wherein the movable member includes a clamp portion that when the movable member is in the closed condition engages the intermediate portion of the cable.

3. A safety lockout hasp according to claim 2 wherein the body includes an abutment portion which combines with the clamp portion of the movable member to engage the cable when the movable member is in the closed position.

4. A safety lockout hasp according to claim 3 wherein the clamp portion and/or the abutment portion includes at least one tooth which resiliently deforms the intermediate portion of the cable when the movable member is in the closed condition.

5. A safety lockout hasp according to claim 1 including biasing means for biasing the movable member towards the closed condition.

6. A safety lockout hasp according to claim 1 wherein the movable member includes an engaging portion for additionally or alternatively engaging the plant, whereby when the movable member is in the open condition the engaging portion can engage and disengage from the plant, and when in a closed condition the engaging portion is prevented from engaging and disengaging from the plant when the hasp is accommodating said at least one locking means.

7. A safety lockout hasp according to claim 6 wherein the engaging portion is in the form of a shackle.

8. A safety lockout hasp according to claim 1 wherein the movable member includes a lock receiving portion which accommodates the plurality of locking means.

9. A safety lockout hasp according to claim 8 wherein the lock receiving portion includes a plurality of apertures each extending through the lock receiving portion with each aperture configured to accommodate one of said plurality of locking means.

10. A safety lockout hasp according to claim 9 wherein the apertures in the lock receiving portion are obscured when the movable member is in the open condition so as to prevent accommodating any of the locking means.

11. A safety lockout hasp according to claim 1 wherein the locking means is a padlock and each aperture in the lock receiving portion is configured to accommodate a shackle portion of the padlock.

12. A safety lockout hasp according to claim 11 wherein the shackle of the padlock abuts the body when preventing movement of the movable member from the closed position.

13. A safety lockout hasp according to claim 1 wherein the movable member is fixed to the body and the body includes a pair of stops that limit movement of the movable member between the open and closed conditions.

14. A safety lockout hasp according to claim 1 wherein the body includes a cable aperture to receive the cable adjacent a proximal end thereof, the cable having an enlarged proximal end to prevent the cable from being pulled through the cable aperture so as to relatively fix the cable to the body.

15. A safety lockout hasp according to claim 14 wherein the cable includes a block at a proximal end which abuts the body surrounding the cable aperture to prevent the cabled being pulled through.

16. A safety lockout hasp according to claim 1 wherein the body includes a further aperture which in use can accommodate a further lock means or further hasp so as to prevent movement of the movable member from the closed position.

17. A safety lockout hasp according to claim 16 wherein the body is formed with a front wall and a rear wall, wherein the further aperture extends through the front wall and the rear wall.

18. A safety lockout hasp according to claim 17 wherein the movable member and body are arranged such that the movement of movable member from the closed condition obscures the further aperture.

19. A safety lockout hasp according to claim 1 wherein the body and the movable member are each configured to prevent attachment of any of said locking means thereto when the movable member is in the open condition.

20. A safety lockout hasp according to claim 1 wherein the movable member is configured to interact with the body such that in use in the open condition the intermediate portion of the cable is free to move relative to the body.

* * * * *